US012533597B2

(12) United States Patent
Aston et al.

(10) Patent No.: US 12,533,597 B2
(45) Date of Patent: Jan. 27, 2026

(54) AUTOMATIC FLY OUT OF THE BOX TOY

(71) Applicant: MGA Entertainment, Inc, Chatsworth, CA (US)

(72) Inventors: Chong Kwong Ho Aston, Kowloon (HK); Wong Siu Hong, Kowloon (HK)

(73) Assignee: MGA ENTERTAINMENT, INC, Chatsworth, CA (US)

( * ) Notice: Subject to any disclaimer, the term of this patent is extended or adjusted under 35 U.S.C. 154(b) by 179 days.

(21) Appl. No.: 18/363,114

(22) Filed: Aug. 1, 2023

(65) Prior Publication Data

US 2025/0041745 A1 Feb. 6, 2025

(51) Int. Cl.

| | |
|---|---|
| ***A63H 13/16*** | (2006.01) |
| ***A63H 17/28*** | (2006.01) |
| ***A63H 27/00*** | (2006.01) |
| ***A63H 27/14*** | (2006.01) |

(52) U.S. Cl.

CPC ..... *A63H 13/16* (2013.01); *A63H 17/28* (2013.01); *A63H 27/12* (2013.01); *A63H 27/14* (2013.01)

(58) Field of Classification Search

CPC ..... A63H 13/16; A63H 17/28; A63H 27/12; A63H 27/14; A63H 29/22; A63H 30/04

USPC ..... 446/34, 36, 40, 45, 57, 230, 233, 234, 446/255, 310, 429, 435

See application file for complete search history.

(56) References Cited

U.S. PATENT DOCUMENTS

| | | | | | |
|---|---|---|---|---|---|
| 2,731,767 | A * | 1/1956 | Holt | A63H 27/14 | 244/17.11 |
| 3,151,866 | A * | 10/1964 | Glass | A63H 33/003 | 273/379 |
| 3,269,055 | A * | 8/1966 | Gordon | A63H 1/02 | 446/259 |
| 3,473,256 | A * | 10/1969 | Tyler | A63H 27/14 | 446/38 |
| 3,572,715 | A * | 3/1971 | Ramirez | A63H 13/16 | 124/31 |
| 4,192,093 | A * | 3/1980 | Hamano | A63H 17/00 | 446/435 |
| 4,464,860 | A * | 8/1984 | Onodera | A63H 17/008 | 238/10 R |
| 4,504,239 | A * | 3/1985 | Kulesza | A63H 27/12 | 446/435 |
| 4,654,018 | A * | 3/1987 | Farrington | A63H 27/14 | 446/330 |
| 4,737,135 | A * | 4/1988 | Johnson | A63H 17/008 | 446/435 |

(Continued)

*Primary Examiner* — Alexander R Niconovich
(74) *Attorney, Agent, or Firm* — Thomas Coester Intellectual Property

(57) ABSTRACT

A flying toy that automatically flies out of its container when the container is opened. A toy has a self-contained power source, a processor coupled to the power source by a circuit and a propeller driven by the actuator. The processor controls an actuator that drives the propeller. The toy defines an opening from an external surface to the circuit. A container for the toy defines a seat for the toy that uniquely forces an orientation of the toy when in the container. The container has a lid and a mechanical interrupter that inserts into the opening when the lid is closed. Opening the lid causes withdrawal of the mechanical interrupter to close the circuit. The toy automatically flies out of the container responsive to the circuit closing.

12 Claims, 14 Drawing Sheets

(56) References Cited

U.S. PATENT DOCUMENTS 4,781,642 A * 11/1988 Stanzel ..... A63H 27/14 446/45
5,345,153 A * 9/1994 Vaught ..... A47G 33/0809 318/4
5,525,086 A * 6/1996 Gentile ..... A63H 27/10 446/37
5,579,813 A * 12/1996 Watts ..... A63H 13/16 116/DIG. 9
5,935,013 A * 8/1999 McLennan ..... A63H 27/10 472/54
6,106,361 A * 8/2000 Petris ..... A63H 30/04 446/454
7,018,264 B2 * 3/2006 Foster ..... A63H 17/006 446/454
7,121,917 B2 * 10/2006 Hardouin ..... A63H 30/04 446/470
7,535,454 B2 * 5/2009 Jasso ..... G06F 1/169 345/172
7,950,977 B2 * 5/2011 Sun ..... A63H 17/008 446/470
8,974,264 B2 * 3/2015 McCafferty ..... A63H 13/16 446/430
9,358,474 B2 * 6/2016 Rehkemper ..... A63H 3/52
10,894,219 B1 * 1/2021 Parker ..... A63H 30/04
12,128,327 B1 * 10/2024 Shi ..... A63H 33/26
2002/0132556 A1 * 9/2002 So ..... A63H 30/04 446/456
2008/0070472 A1 * 3/2008 Campbell ..... A63H 17/008 446/429
2009/0013983 A1 * 1/2009 Polk, III ..... A63H 27/14 124/6
2010/0144234 A1 * 6/2010 Wai ..... A63H 30/04 446/76
2010/0159799 A1 * 6/2010 Nardin ..... A63H 13/16 446/310
2013/0273804 A1 * 10/2013 Rossi ..... A63H 13/16 446/310
2019/0291015 A1 * 9/2019 Cumings ..... A63H 33/00
2022/0118373 A1 * 4/2022 Del Giudice ..... A63J 21/00

* cited by examiner

AUTOMATIC FLY OUT OF THE BOX TOY

BACKGROUND

Field

Embodiments of the invention relate to flying toys. More specifically, embodiments of the invention relate to a toy that flies out of its box automatically when the box is opened.

Background

Powered flying toys of various types have become commonplace. Helicopter, blimps and the like have existed for many years. Technology to control vertical and horizontal proximity to object has proliferated. Much effort gone in to making them stable in flight. Counter rotating propellers and various stabilization schemes have been employed. Often the toys are remote controlled. That is, a handheld console send signal to a processor in the toy that drives actuators to change the speed and direction of the toy by changing the angle or sped of rotation of the propeller(s).

More recently, flying dolls or fairies have become increasingly popular. Such toys often employ vertical distance sensors to cause the doll to appear to hover above e.g., a user's hand. The fairies typically do not receive external control signals form a remote control, rather their positioning is controlled responsive to the sensing of vertical proximity to a surface.

Common to existing toys is the play sequence that the toy is removed from it packaging and switch on to engage the motor that drives the propeller that provided the lift for the toy. Thereafter, the toy may engage its propeller or await a signal from the remote control to initiate flight.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Figure 1:
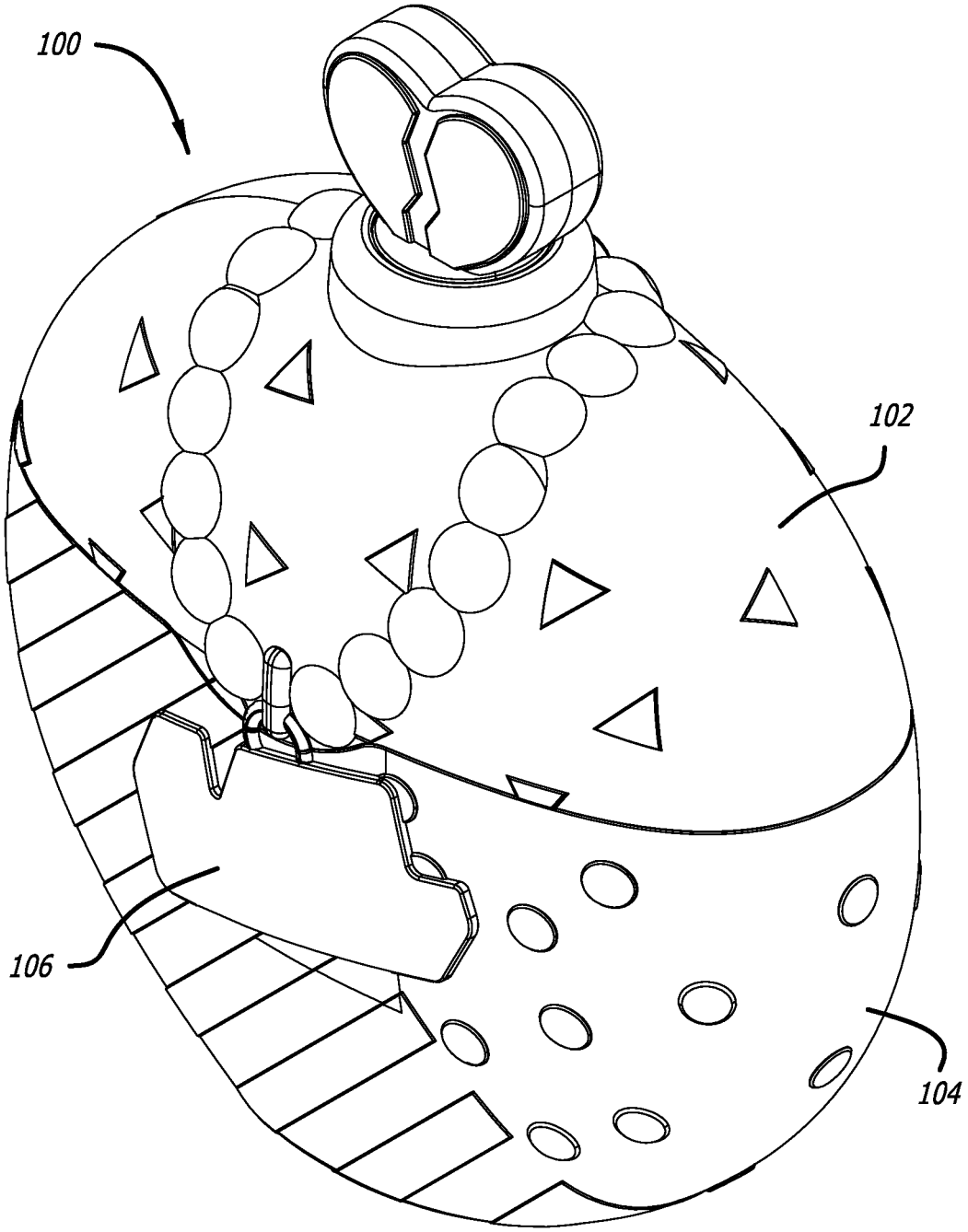
FIG. 1 is and elevated external perspective view of a container according to one embodiment of the invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

FIG. 1 is and elevated external perspective view of a container according to one embodiment of the invention. In one embodiment a container 100 has a clamshell configuration. A lid 102 sits atop a base 104 and encloses and internal volume. In some embodiments, the lid 102 and base 104 may be molded or cast from a synthetic material. In some embodiments, the synthetic material may be translucent such that light within the internal volume can be seen externally while the container 100 is closed.

In some embodiments, container may have a touch sensing region 106. In the shown embodiment, touch sensing region 106 is part of base 104. In other embodiments, touch sensing region 106 could be part f the lid. In still other embodiments, touch sensing region 106 could be omitted. In some embodiment, touch sensing region 106 uses one or more capacitive sensors (not shown in FIG. 1) to sense when a user touches the touch sensing region 106. In other embodiments, pressure sensors, vibration sensors or the like can be used to determine if a touch event has occurred in the touch sensing region.

Figure 2:
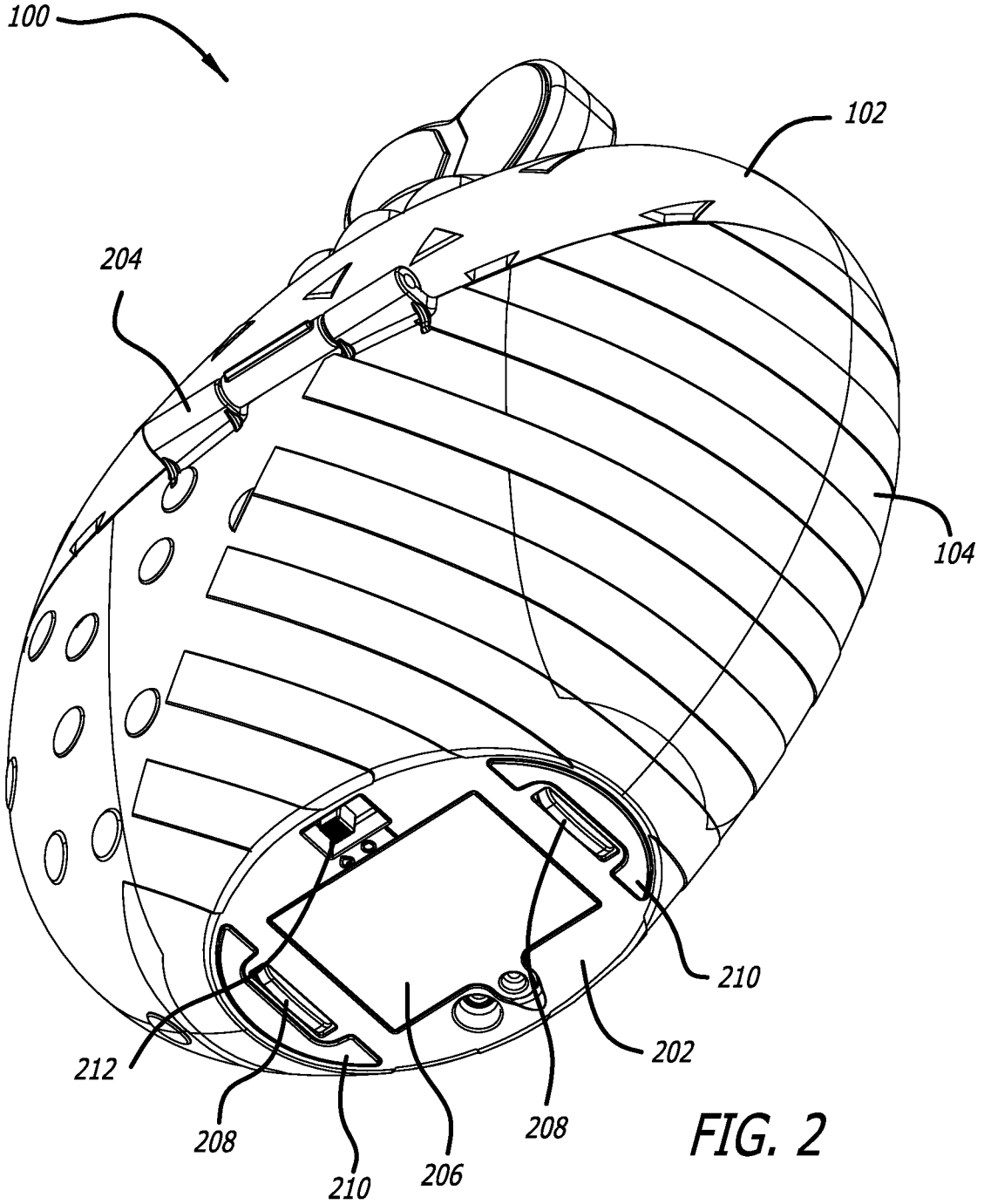
FIG. 2 is a bottom rear external perspective view of a container according to one embodiment of the invention.

FIG. 2 is a bottom rear external perspective view of a container according to one embodiment of the invention. A hinge 204 can be seen coupling lid 102 to base 104. Hinge 204 permits the lid to rotate more than 90° so that the lid 102 does not occlude the internal volume when the container 100 is in an open configuration. Preferably, the hinge permits the lid 102 to rotate in the range of 120° to 180° relative to the closed configuration.

Base 104 has formed as part there of a substantially flat bottom that allow the container 100 to stand upright on a flat surface. In some embodiments, a pair of feet 208 are exposed through openings in the bottom 202. A battery door 206 in the base 102 encloses a battery compartment that can contain batteries to provide an internal self-contained power source for the container 100. In some embodiments, elastomeric grips 210 may be coupled to the bottom 202 to reduce slipping on a supporting surface. Some embodiments including a multi-positional switch 212 that can change a mode of operation of the container. Different operational modes are described in greater detail below.

Figure 3:
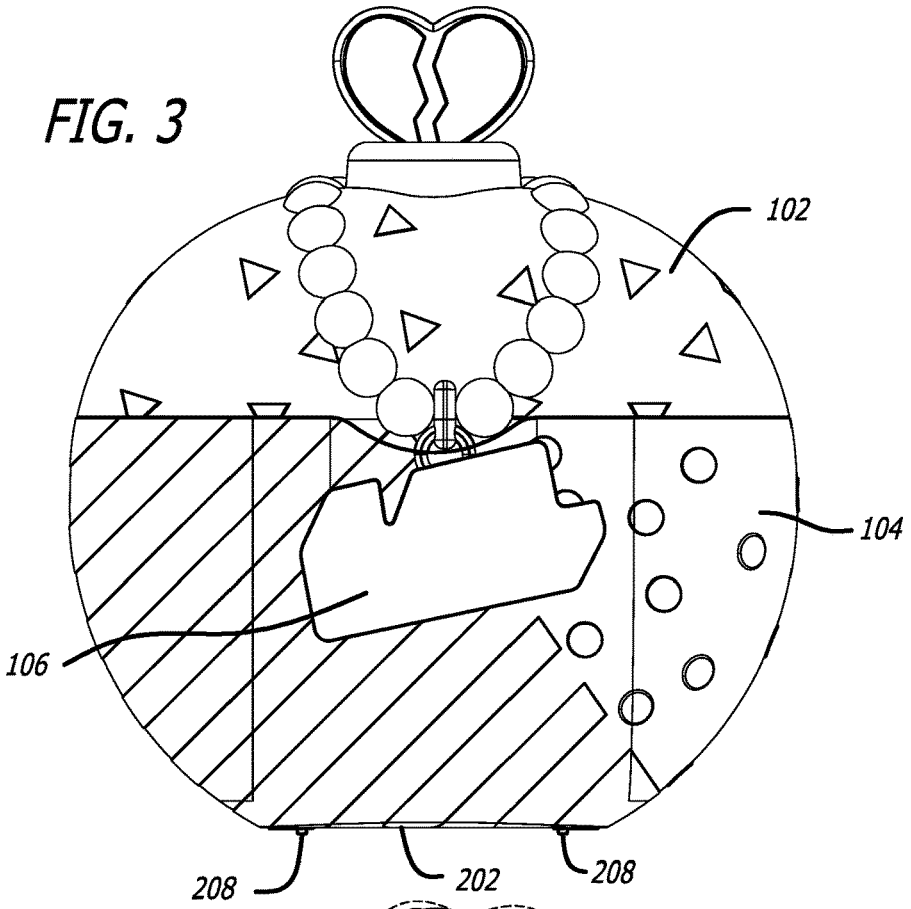
FIG. 3 is a front external view of a container according to one embodiment of the invention.

FIG. 3 is a front external view of a container according to one embodiment of the invention. In this view, the container 100 is stationary and the lid 102, base 104 and feet 208 are visible. In some embodiments, feet may extend slightly from the bottom 202, when the container 100 is not active. In other embodiments, the feet 208 are substantially flush with the bottom 202 when the container is not active. In some embodiments, the container becomes active responsive to a touch or series of touches on the touch sensing region. In some embodiments, how the container 100 respond to the touch may change depending on the mode in which the container 100 is operating.

Figure 4:
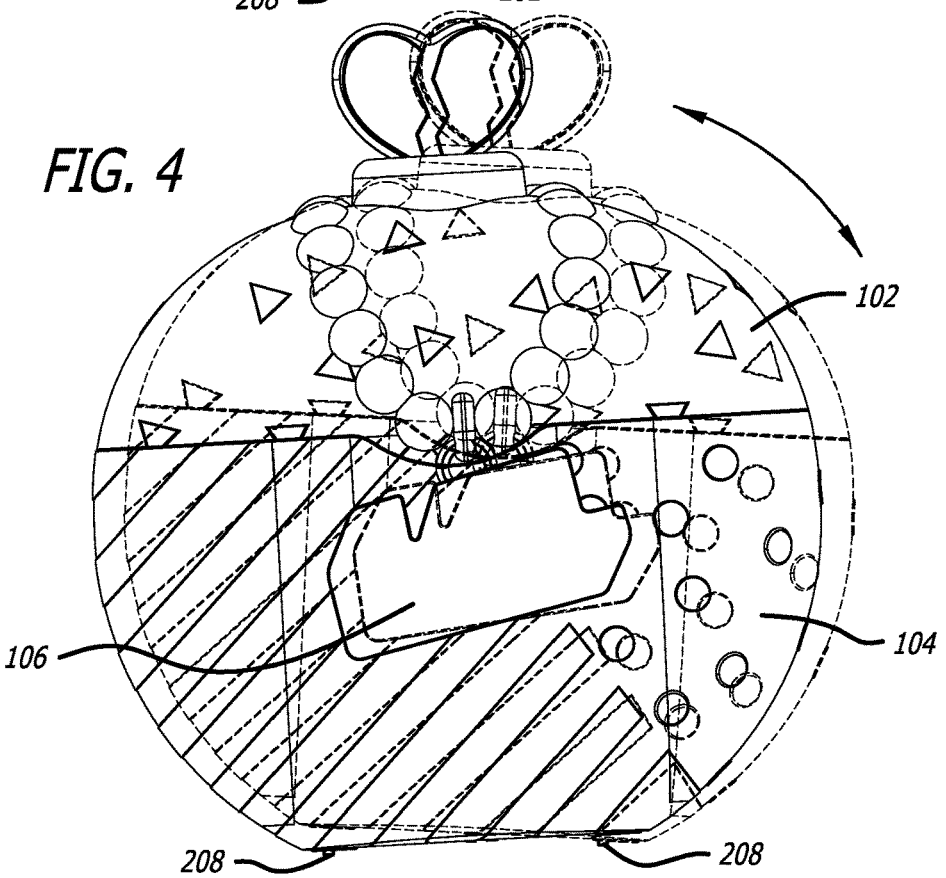
FIG. 4 is a front external view showing the container rocking according to one embodiment of the invention.

FIG. 4 is a front external view showing the container rocking according to one embodiment of the invention. Responsive to a touch or series of touches on the touch sensing region 106, an actuator inside the base 104 alternately drives the feet 208 to cause the container to rock or vibrate. Alternately driving the feet 208 a very small amount (fractions of a millimeter) causes the container to vibrate. Driving the feet 208 larger amounts 1-3 mm causes the container 100 to rock from side to side. In embodiments where no feet are present, a vibration effect can be achieved by for example driving an eccentric mass within the container 100.

Figure 5:
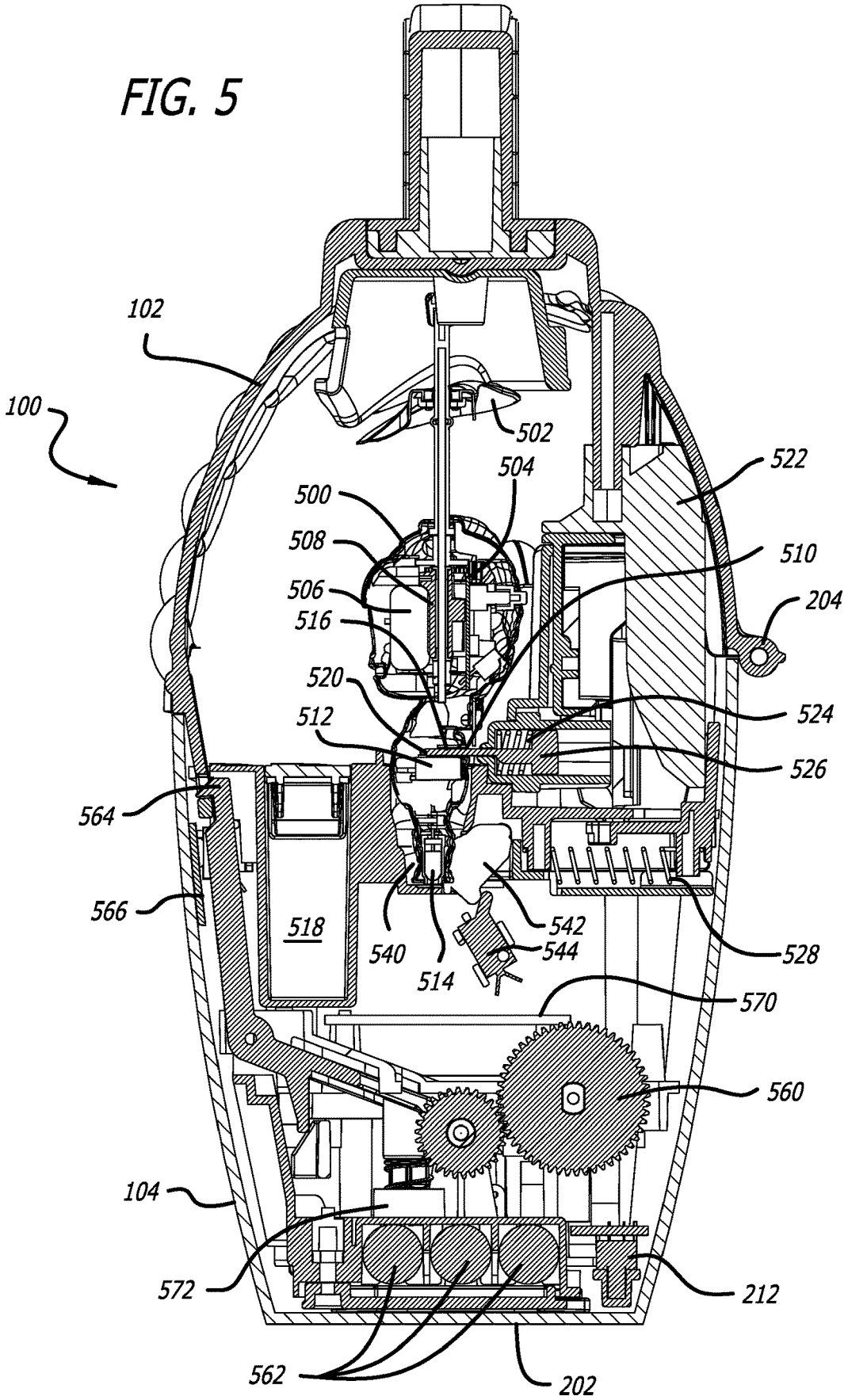
FIG. 5 is a sectional view of a toy of one embodiment of the invention within the container in a closed configuration.

FIG. 5 is a sectional view of a toy of one embodiment of the invention within the container in a closed configuration. A flying toy 500, such as a flying doll, is retained within the container in a seat 540 dimensioned to force the toy 500 to adopt a known orientation then the toy 500 is in the seat 540. That is the seat 540 is effectively keyed to the toy 500 so that the toy can only reside in the seat in a single orientation. The toy 500, has a propeller that when driven by an actuator 512 enable the toy to fly. A vertical distance sensor 514 is provided in the bottom of the toy 500 (distal to propeller 502) to allow the toy to hover above a surface when in flight. Toy 500 contains a power source 506 that powers actuator 512 and processor 508. The actuator 512, when activated causes the propeller 502 to rotate. Actuator can drive the propeller 502 at different rotational speeds responsive to signaling from the processor 508. In various embodiments, actuator 512 may be a dc motor, a gyro, a servo, a piezo electric motor, or the like.

Processor 508 is responsible to controlling operation of the toy 500. Processor 508 may be a microprocessor, a micro controller, an application specific integrated circuit (ASIC) or the like. Processor 508 controls the actuator to drive the propellor and interprets the signal from the vertical distance sensor 514. Processor 508 is electrically coupled to the actuator 512 via a switch 516. When the switch 516 is closed, the circuit between the processor 508 and the actuator 506 is complete and the processor can activate the actuator 512.

The external surface of toy 500 defines an opening 510 that, when the toy 500 is in the seat 540, provides access to the switch 516 by a mechanical interrupter such as pin 520 that when inserted into the opening 510 interrupts the switch, they by opening the circuit an preventing the processor from activating the actuator 512. Pin 520 is caused to remain within the opening and interrupt the switch 516 while the lid 102 is closed.

Various elements form a mechanical linkage to ensure the pin 526 interrupts the circuit when the lid 102 is closed. While the operation is better understood with reference to FIGS. 7-9 below, various element of the linkage can be seen in this figure. A first bias element 524 exerts a force to bias the disengagement of the pin 520 from the toy 500. Bias element 524 acts on the pin head 526 to push it away from the opening 510. A second bias element 528 is stretched in the closed configuration. A cam blade 522 is coupled to or integrally molded with the lid 102. As the lid closes, cam blade forces the bias element 524 and 528 in to compressed and stretched conditions respectively. Removal of the cam blade 522 as the lid 102 rotates into an open configuration allows the bias elements to return to equilibrium resulting in the removal of the pin when the lid 102 achieves a defined degree of openness.

Power source 506 may be a rechargeable battery such as a lithium-ion battery or the like. In other embodiments, power source 506 may be a super capacitor or set of supercapacitors. A charge port 504 is provided to permit recharging of the of the power source 506. Charge port 504 may accept mini USB, micro USB or similar connectors. In some embodiment, the charge port 504 may be omitted and an inductive receive coil may be provided to permit inductive charging of the power source 506.

In some embodiments, container 100 has a processor 570 disposed therein. Container processor 570 is independent of the toy processor 508. Processor 570 may be a microprocessor, a micro controller, an application specific integrated circuit (ASIC) or the like. Processor 570 controls the functions for the container as described more fully below. Switch 212 signals processor 570 what mode the container is operating in. In some embodiments, various sensors within the container provide inputs to the processor 570. For example, touch sensor 566, which may underly the touch sensing region of the container is operatively coupled to processor 570 to signal when a touch event has been detected. In some embodiments touch sensor 566 may be a capacitive sensor. In other embodiments touch sensor 566 may be a pressure senor or vibrational sensor. When the processor 570 receives a touch event, it causes the container 100 to behave in a defined manner based on the mode defined by the switch 212 and how many touch events have been received. Different behaviors of the container are described in more detail below.

In some embodiment, seat sensor 544 is operatively couple to processor 570 to signal processor 570 whether or not toy 500 is in seat 540. In one embodiment, sensor 544 includes a switch engaged by resilient element 542. When toy 500 is seated in seat 540 the feet of the toy apply a force to element 542 causing it to move mechanically to engage the switch of seat sensor 544. If the toy 500 is removed, element 542 does not engage the switch of sensor 544.

In one embodiment, lid 102 is held closed by a levered latch 564. In some embodiments, processor 570 controls an actuator 572 to drive a gear train 560 to open the latch 564 responsive to a defined touch pattern. In various embodiments, actuator 572 may be a dc motor, a gyro, a servo, a piezo electric motor, or the like. In some embodiments, the gear train 560 may be used drive the feet to create the rocking discussed above. In some embodiment, a cable compartment 518 is defined with in the container 100. Cable compartment can contain a charging cable for the toy 500, e.g. micro USB to USB cable. In some embodiments, the gear train may be omitted and the actuator 572 may spin an eccentric mass to cause the container 100 to vibrate.

Container power source 562 may be rechargeable or non-rechargeable batteries such as lithium-ion batteries, alkaline batteries or the like. Power source 562 provides power to controller 570 and other electrical components that are part of the container 100. In some embodiments, power source 562 may be replaced or supplemented with a wall cord.

Figure 6:
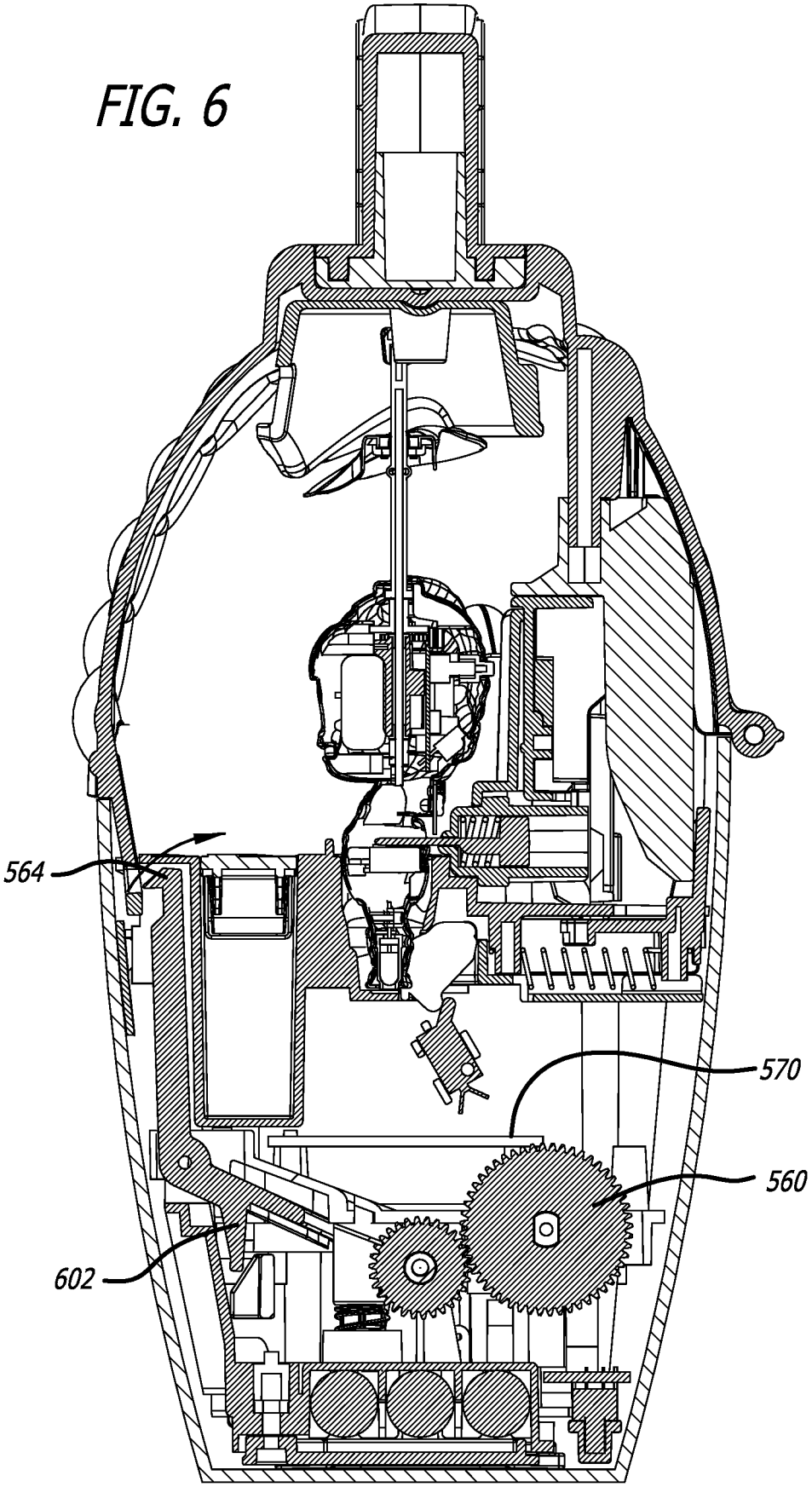
FIG. 6 is a sectional view of a toy of one embodiment of the invention within the container in a closed configuration with the latch disengaged.

FIG. 6 is a sectional view of a toy of one embodiment of the invention within the container in a closed configuration with the latch disengaged. Processor 570 has caused gear train 560 to drive a mechanical linkage to exert a force on lever arm 602 that cause the latch to disengage. While in various embodiments, the latch 564 can be opened manually, the automatic disengagement of the latch responsive to touch events improves the play experience.

Figure 7A:
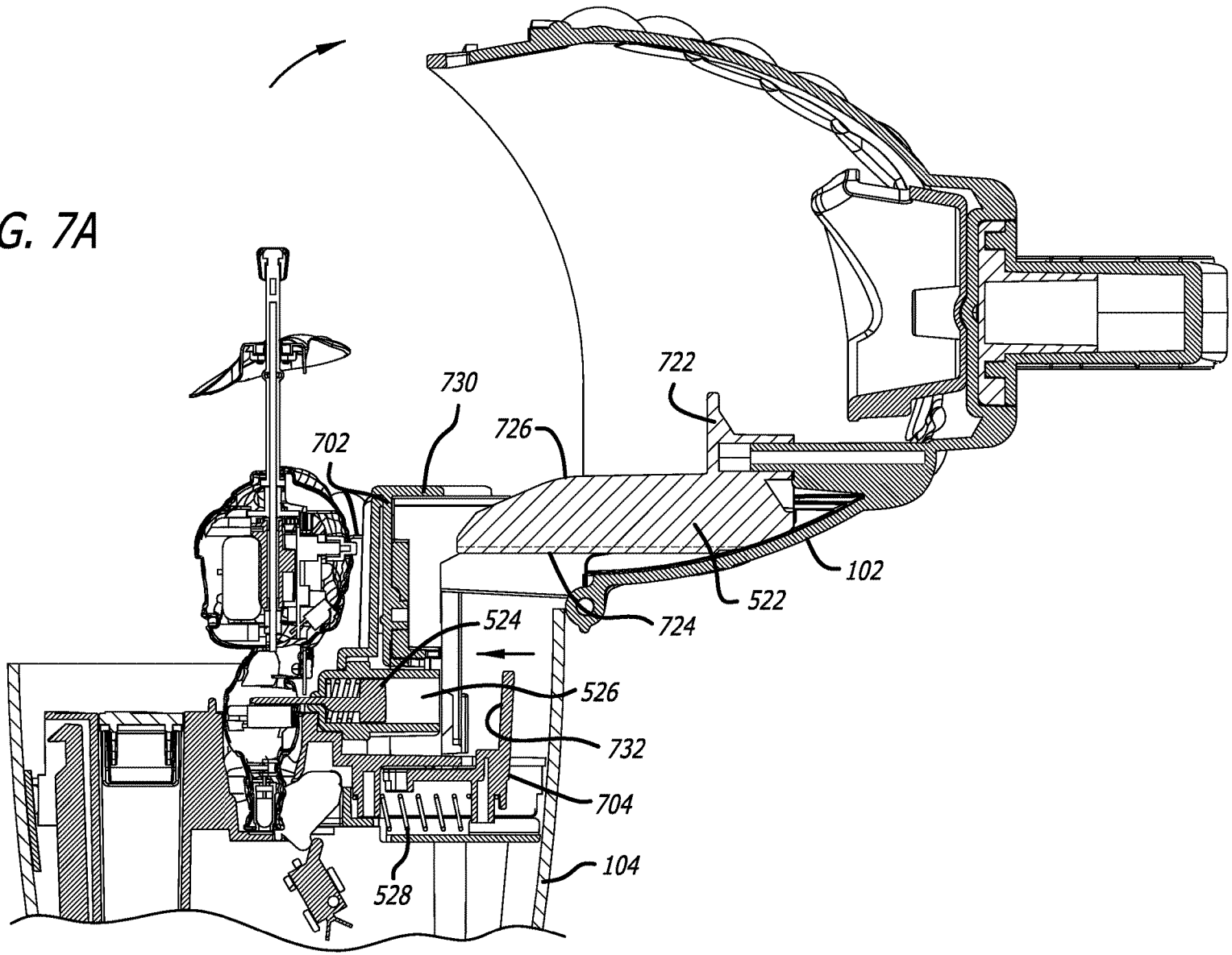
FIGS. 7A-9 are partial sectional views of the toy and container showing the operation of the pin linkage according to one embodiment of the invention.

FIGS. 7A-9 are partial sectional views of the toy and container showing the operation of the pin linkage according to one embodiment of the invention. In FIG. 7A, the lid 102 is shown partially open. When the lid 102 is opened, outer edge 724 of cam blade 522 disengages from surface 732 of link element 704. This allows bias element 528 to release returning to an unstretched state. Link element 704 is mechanically coupled to pinhead 526 such that when bias element 528 is stretched and oppositely directed force compresses bias element 524. When bias element returns to equilibrium, that compressive force is removed from bias element 524.

Figure 7B:
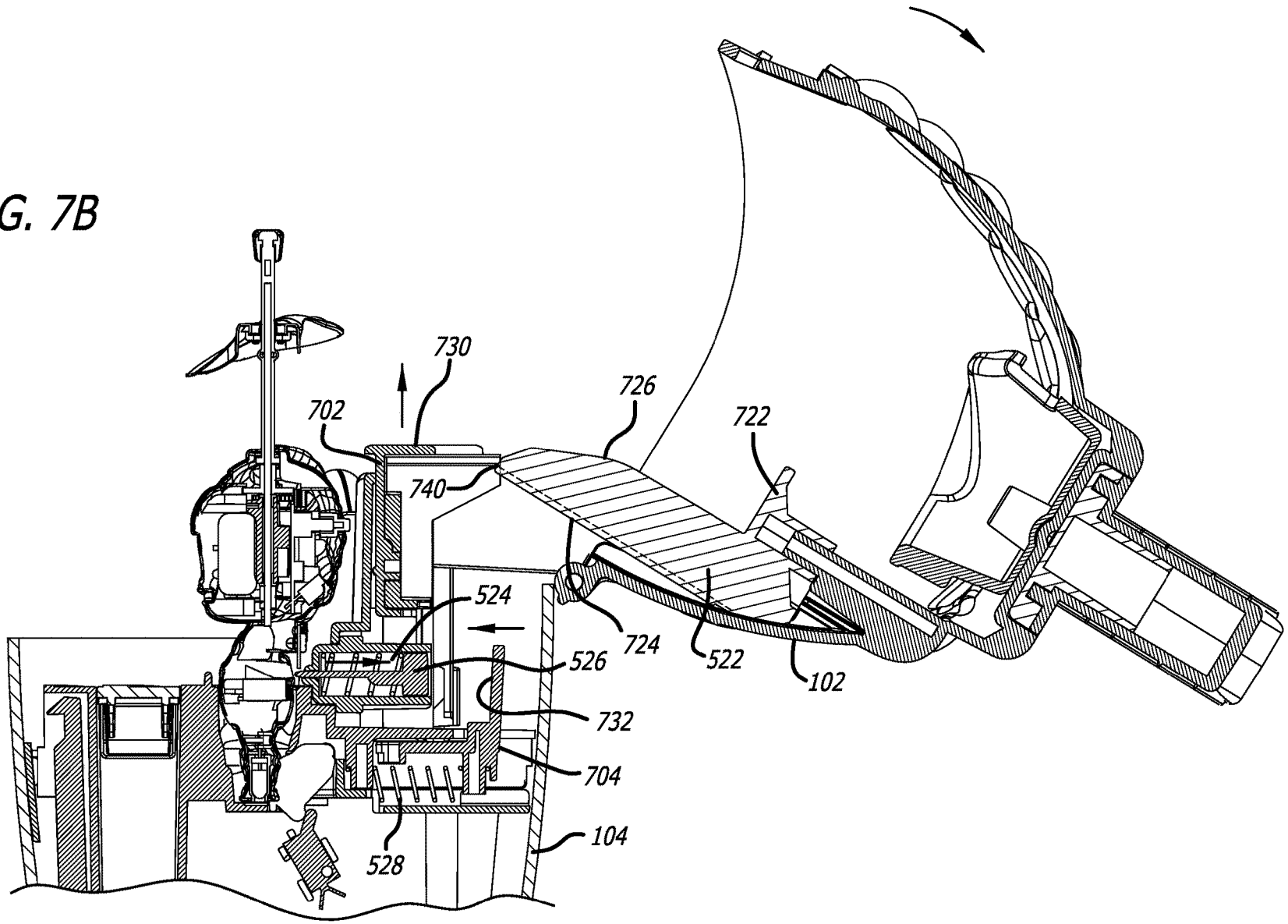

However, it is important to avoid removing the pin until lid 102 has completely cleared the base 104. That is lid must have gone past 90° and preferable past 120° before the pin is released. FIG. 7B shows the lid 102 opened to a threshold degree. At the threshold the lid 102 is certain not to occlude the flyout path of the toy 500. Link element 702 moves downward in the closed configuration as a result of the force of surface 722 on surface 730. Surface 804 of link element 702 engages lateral extension 806 of pin head 526 and hold it in place while link element 702 is driven down. A relatively week bias element (802 in FIG. 8) biases link element 702 upward to remove the engagement between surface 804 and lateral extension 806 to free the pin head 526. A detent with a holding force greater than the bias force of bias element 804 prevents release of the pin head 526 until the tapered end 740 of cam blade 522 engages fins 902 and overcomes the holding force of the detent. This occurs when the lid is greater than the desired threshold open. Cam blade 522 has a T-shaped cross section (best seen in FIG. 10). It is the cross of the T at the tapered end that catches the fins 902 to overcome the detent. Once the detent is overcome, bias element 804 pushes the link element 702 upward and bias element 524 snaps the pin 520 out of the toy 500 enabling it to fly.

Figure 8:
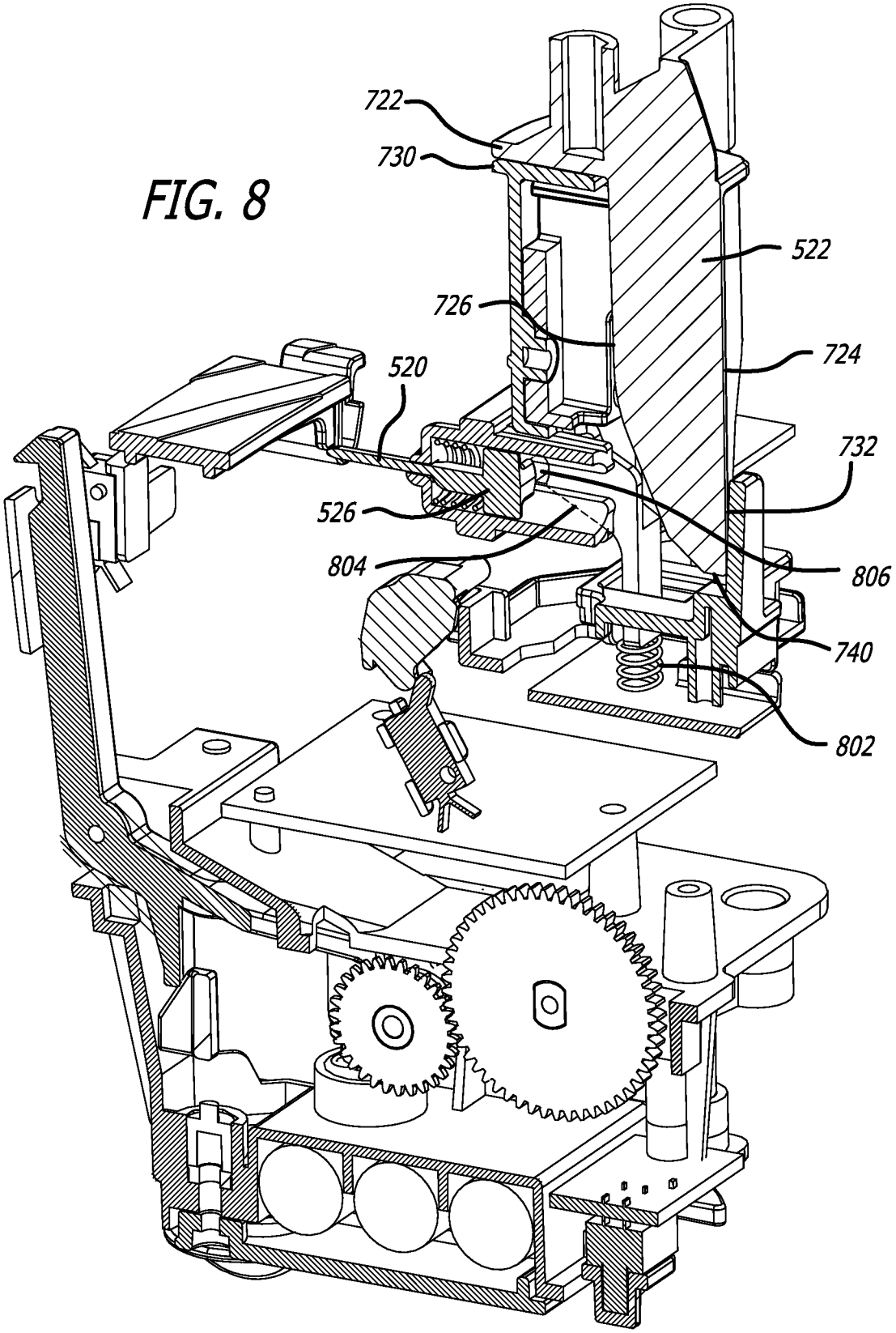
Figure 9:
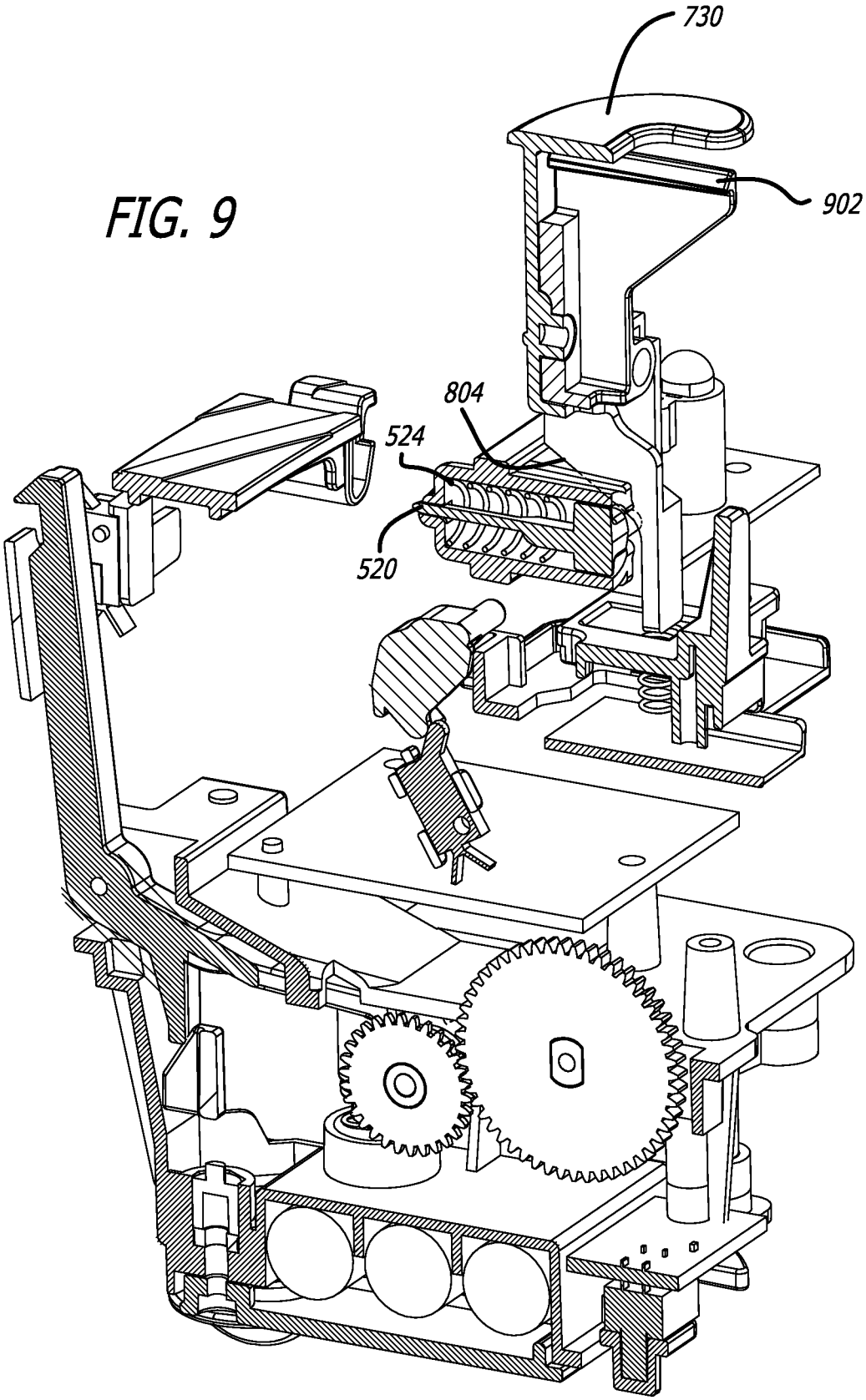

FIG. 8 shows the linkage in a closed configuration. As set forth above, in this state, outer edge 724 applies a force on link surface 732 which stretches bias element 528 (not visible in this figure). Surface 722 applies a downward force on surface 730 thereby compressing bias element 802 and force surface 804 to engage lateral extension 806. In this state, pin 520 is held extended, will penetrate the opening of the toy 500, when present and prevent operation. FIG. 9 again shows the open state (the lid has opened beyond the threshold) in which the pin 520 is retracted. Surface 804 is elevated and does not restrict the bias element 524 from returning to equilibrium.

Figure 10:
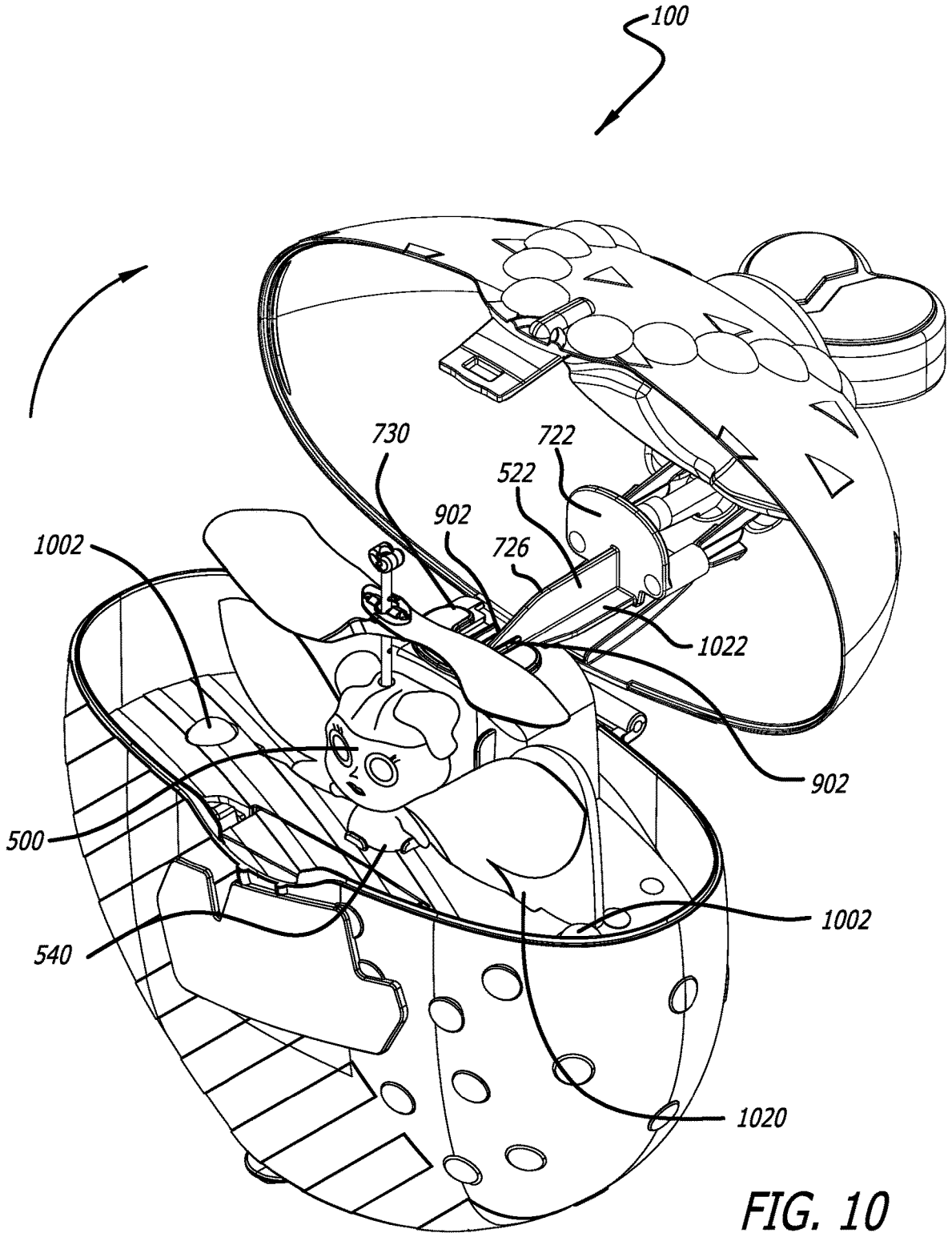
FIG. 10 is a perspective view of the container opened nearly to the threshold with the toy in the seat.

FIG. 10 is a perspective view of the container opened nearly to the threshold with the toy in the seat. Crosspiece 1022 of cam blade 522 engages the underside of fins 902 at the threshold. As the lid 102 opens further upward pressure of the crosspiece 1022 on the fins 902 overcomes the detent holding link element 730 in place bias element 802 (not visible in this figure) forces link element 730 in a vertical direction freeing cam blade 522 and allowing the lid 102 to open further beyond the threshold. This also result in the removal of the pin as described above.

In some embodiments, one or more light sources 1002 may be disposed within the container. In some embodiments, light sources 1002 may be one or a collection of light emitting diodes (LEDs) that can be selectively illuminated under the control of a process to produce a pattern of illumination. A pattern of illumination can be defined by time of illumination, color of illumination or both.

In some embodiments in addition to seat 540, the container defines additional recesses to accommodate other features of the toy 500. For example, there the toy 500 is a flying fairy, the container 100 mat define wing slots 1020 to accommodate the fairy's wings. While generally seat 540 is sufficient to dictate the orientation of the toy 500 in the container 100, wing slots 1020 provide additional guidance to ensure small children can properly orient the toy 500.

Figure 11:
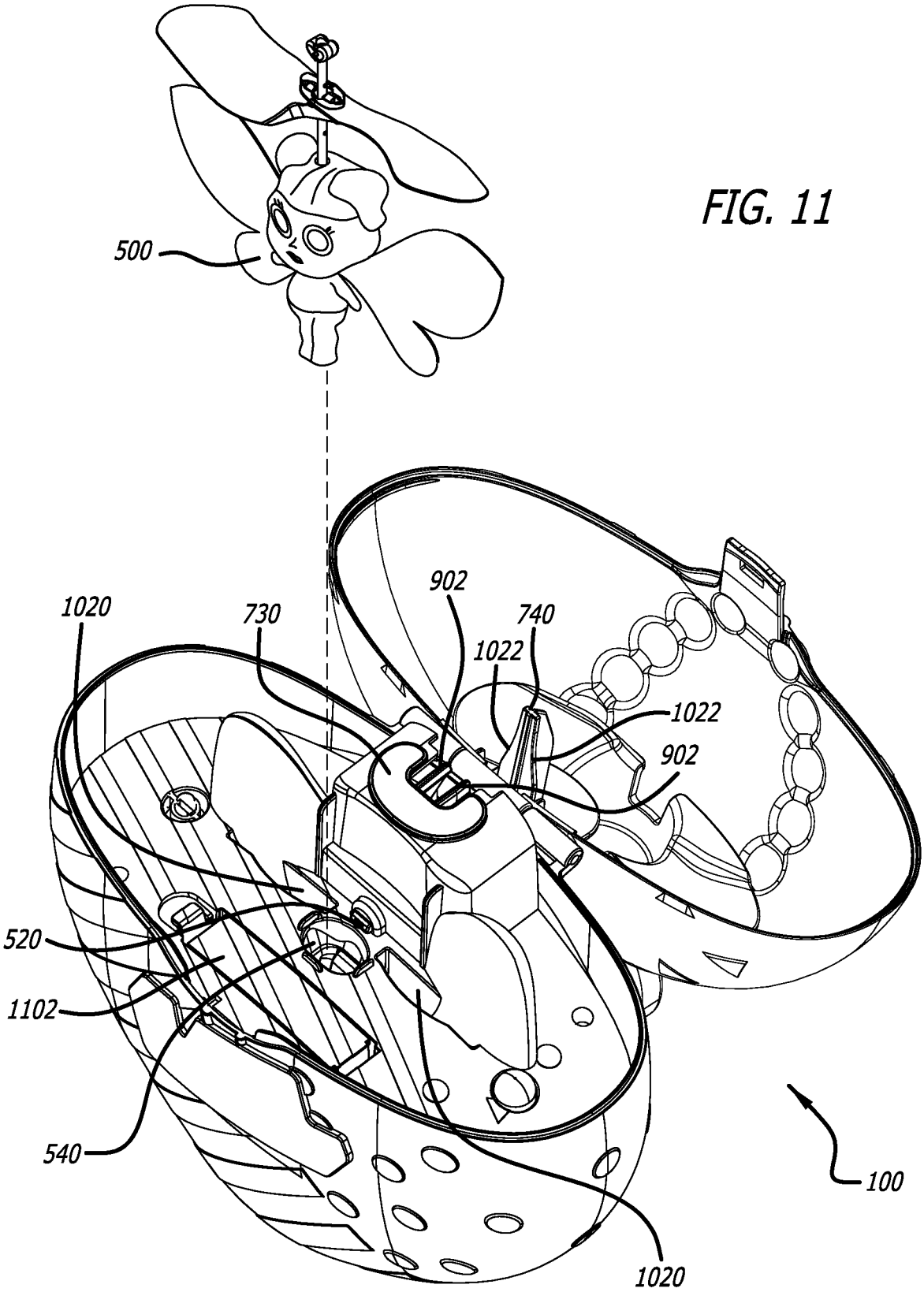
FIG. 11 is a perspective view of the container opened beyond the threshold with the toy having flown automatically out of the container.

FIG. 11 is a perspective view of the container opened beyond the threshold with the toy having flown automatically out of the container. In this view lid 102 is opened beyond the threshold, here to substantially 180° relative to the closed state. Toy 500 has automatically flown out of the container 100 leaving the seat 540 unoccupied. The automatic fly out is responsive to the retraction of pin 520 as described above. The tapered end 740 of cam blade 522 is visible. Because link member 730 is elevated by bias member 802, tapered end 740 passed unimpeded by fins 902 as the lid is subsequently closed. The stem of the T cross section of the cam passes between the fins 902 during closure.

Figure 12:
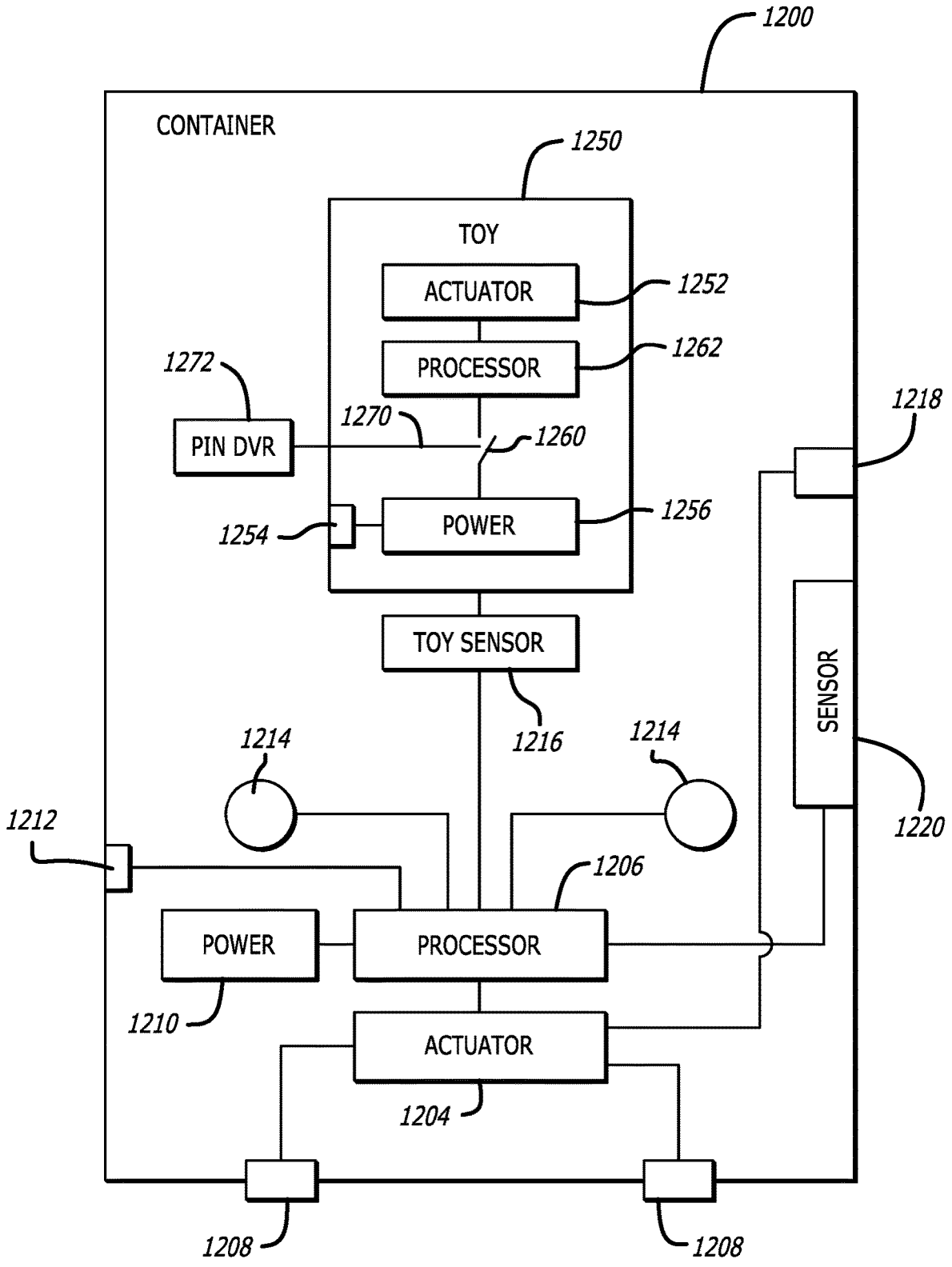
FIG. 12 is a functional block diagram of the toy and container according to one embodiment of the invention.

FIG. 12 is a functional block diagram of the toy and container according to one embodiment of the invention. The flying toy 1250 resided within the container 1200. Typically, the toy 1250 will reside in a seat that mechanically ensures its orientation within the container 1200. The toy includes a processor 1262 to control the operation of the toy. Processor 1262 may be a microprocessor, a micro controller, an ASIC or the like. An actuator 1252 is coupled to and controlled by the processor 1262. Actuator 1252 is responsible for driving the propeller of the toy 1250 causing it to fly. In various embodiments, actuator 1252 may be a dc motor, a gyro, a servo, a piezo electric motor, or the like.

Toy 1250 also includes a self-contained power source 1256. In various embodiments, power source 1256 could be rechargeable batteries, non-rechargeable batteries, super capacitors, or the like. When the power source 1256 is rechargeable, a charge port 1254 may be provided. In some embodiments, charge port 1254 may be compatible with mini USB, micro USB or any suitable connectivity by which current can be delivered to power source 1256. In some embodiment, charge port 1254 may be replaced by an inductive charging receive coil to allow power source 1256 to be charged wirelessly.

A switch 1260 is disposed in a circuit between the power source 1256 and the actuator 1252. While the switch 1260 is shown between the power source 1256 and the processor 1262, in some embodiments it may be located between the processor 1262 and the actuator 1252. While placement of the switch can be in different parts of the circuit, functionally it disable the actuator when the switch is open, that is the circuit is interrupted. When the toy 1250 is in the container and the lid of the container 1200 is closed a mechanical interrupter such as pin 1270 interrupts the circuit by mechanically holding the switch 1260 in an open state.

A pin driver 1272 within the container 1200 controls the pin 1270 to ensure that it is driven into the switch 1260 when the lid of the container 1200 is closed and retracted from the switch 1260 when the lid achieves a threshold level of openness. In various embodiments, the threshold may be in the range of 90° to 180° relative to the closed configuration. In some embodiments, pin driver 1272 may be a mechanical linkage as described above. In other embodiments, pin driver may be a mechanical linkage that bias the pin 1270 into the switch 1260 with a linkage that overcomes that bias as the lid passes the threshold of openness. For example, pin driver 1272 may include a spring biasing the pin 1270 into the switch 1260 and a flexible member coupled between the lid and the spring head dimensions to fully withdraw the pin 1270 at the threshold. In still another embodiment, pin driver 1272 electrically or magnetically actuated. For example, pin driver 1272 may include a solenoid activated response to a hall effect sensor where the hall effect sensor is trigger by proximity to a permanent magnet. The permanent magnet may, for example, be couple to the lid in a location that when the lid is 180° open the magnet is sufficiently proximate to the hall effect sensor to cause the hall effect sensor to trigger the solenoid. In some embodiment rare earth magnets may be used. Other similar electromechanical arrangements are within the scope and contemplation of embodiments of the invention.

Container 1200 may include a processor 1206 that is wholly independent of the processor 1262 in the toy. Processor 1206 may be a microprocessor, a micro controller, an ASIC or the like. Processor 1206 is responsible for controlling the operation of the container 1200 that is independent of the toy. Processor 1206 may receive input from sensors within the container 1200 and control the behavior of the container responsive to the sensor events. In some embodiments, a touch sensitive sensor 1220 generates touch events to signal the processor that a user has touch a touch sensitive area of the container. In some embodiments, touch sensitive sensor 1220 may be a capacitive sensor, a pressure sensor, and/or a vibration sensor. In some embodiments, a toy sensor 1216 is disposed within the container to signal the processor whether or not the toy 1250 is in the seat in the container 1200. In some embodiments, a mode switch 1212 signal the processor what mode the container 1200 is operating in. The operation mode can be used to change the response to events from the sensors 1216 and 1218.

Processor 1206 is powered by a power source 1210 that may be rechargeable or non-rechargeable batteries. In some embodiments, power source 1210 may be a wired source such as a wall outlet. In some embodiments, processor 1206 controls one or more light sources 1214. Processor 1206 may cause the light sources 1214 to light up in a defined pattern responsive to mode and sensor events. The defined pattern may include color and/or duration of light.

In some embodiments, processor 1206 controls one or more actuators 1204. Actuator 1204 may be a dc motor, a gyro, a servo, a piezo electric motor, or the like. Actuator 1204 may drive a gear train or other simple machine to the container to shake/vibrate, rock or unlatch. In one embodiment, actuator 1204 drives feet 1208 in an alternating sequence to cause the container 1200 to rock side to side. Processor 1206 can control the period/length of time and intensity at which the actuator operates. Processor 1206 may change the pattern or activity of the actuator based on mode of operation indicated by switch 1212 and the various sensor events. In some embodiments, processor may cause actuator 1204 to open latch 1218 responsive to one or a series of sensor events.

In some embodiments, the container processor 1206, the actuator 1204, lights 1214 etc. may not be present and container 1200 is just a container with a seat for the toy 1250 and the mechanical interrupter with its driver 1272.

Figure 13:
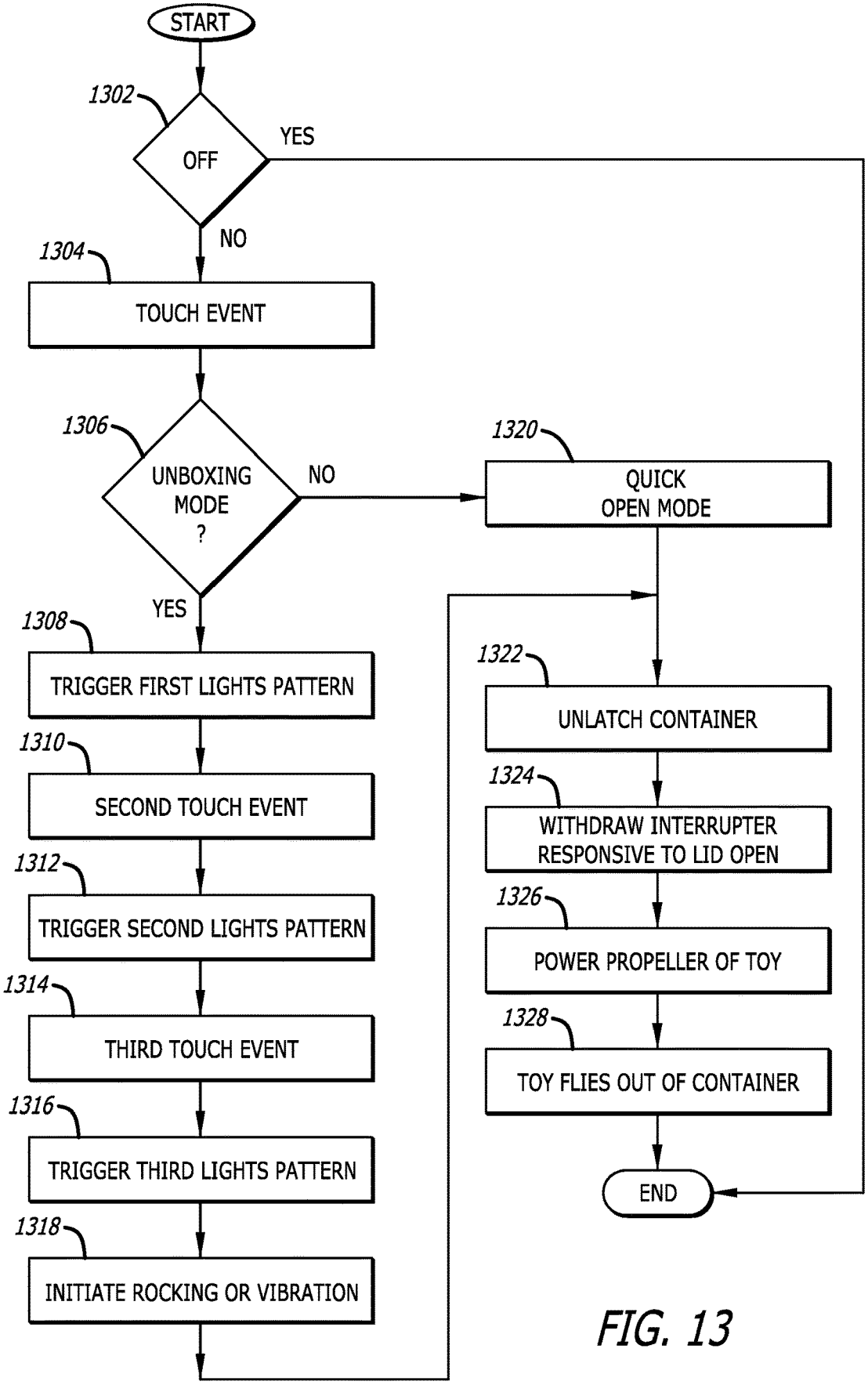
FIG. 13 is a flow diagram operation of the toy and container according to one embodiment of the invention.

FIG. 13 is a flow diagram operation of the toy and container according to one embodiment of the invention. At decision block 1302, if the mode of the container is indicated to be off, the routine ends. If the mode is not off, the container is in an active mode and the processor watches for events. When a touch event occurs at block 1304, a determination is made at decision block 1306 whether the container is in unboxing mode. Typically, the products that have an unboxing mode will be shipped in that mode so that the first user experience is the unboxing mode experience.

If the mode is unboxing mode at decision block 1306, the processor triggers a first light pattern. For example, the light pattern could be a slow flashing of a selected color of light for a defined time period. Response to receipt of a second touch event at block 1310, the processor may trigger a second light pattern at block 1312. The second pattern can be the same as the first or may be different. For example, the second light pattern could flash faster, be different color(s) or a different duration. Responsive to third touch event at block 1314, the processor triggers a third light pattern that may be the same or different than the preceding pattern. The processor also trigger the actuator to cause the container to rock or vibrate. The rocking or vibration may after the light pattern, before the light pattern, coextensive with the light pattern or overlapping with but continuing after the light pattern. In some embodiments, the rocking or vibration may be repeated with each touch event (e.g. first second and third touch events). In some embodiments, the rocking or vibration increases in intensity and/or duration with each successive touch event. The repeated occurrence of light patterns and/or rocking sequences serves to increase the anticipation for the user dur their first interaction with the device. Some embodiments have more or fewer light patterns and or rocking/vibration sequences responsive to touch events. In some embodiments, the light patterns and/or rocking/vibration may be foregone entirely.

If the container is not in unboxing mode at block 1306 it is deemed to be in quick open mode at block 1320. After the first interaction, may users will switch to quick open mode to avoid the delayed of the multitouch sequence to get to the use the flying toy more rapidly. Responsive to the first touch event if in quick open mode or after initiation of the final rocking sequence, the processor causes the actuator to unlatch the container at block 1322. When a user opens the lid beyond the threshold, the mechanical interrupter is withdrawn at block 1324. Responsive to the withdrawal of the interrupter, the propeller of the toy is automatically powered at block 1326 and the toy flies automatically out of the container at block 1328 without requiring further action by the user.

Figure 14:
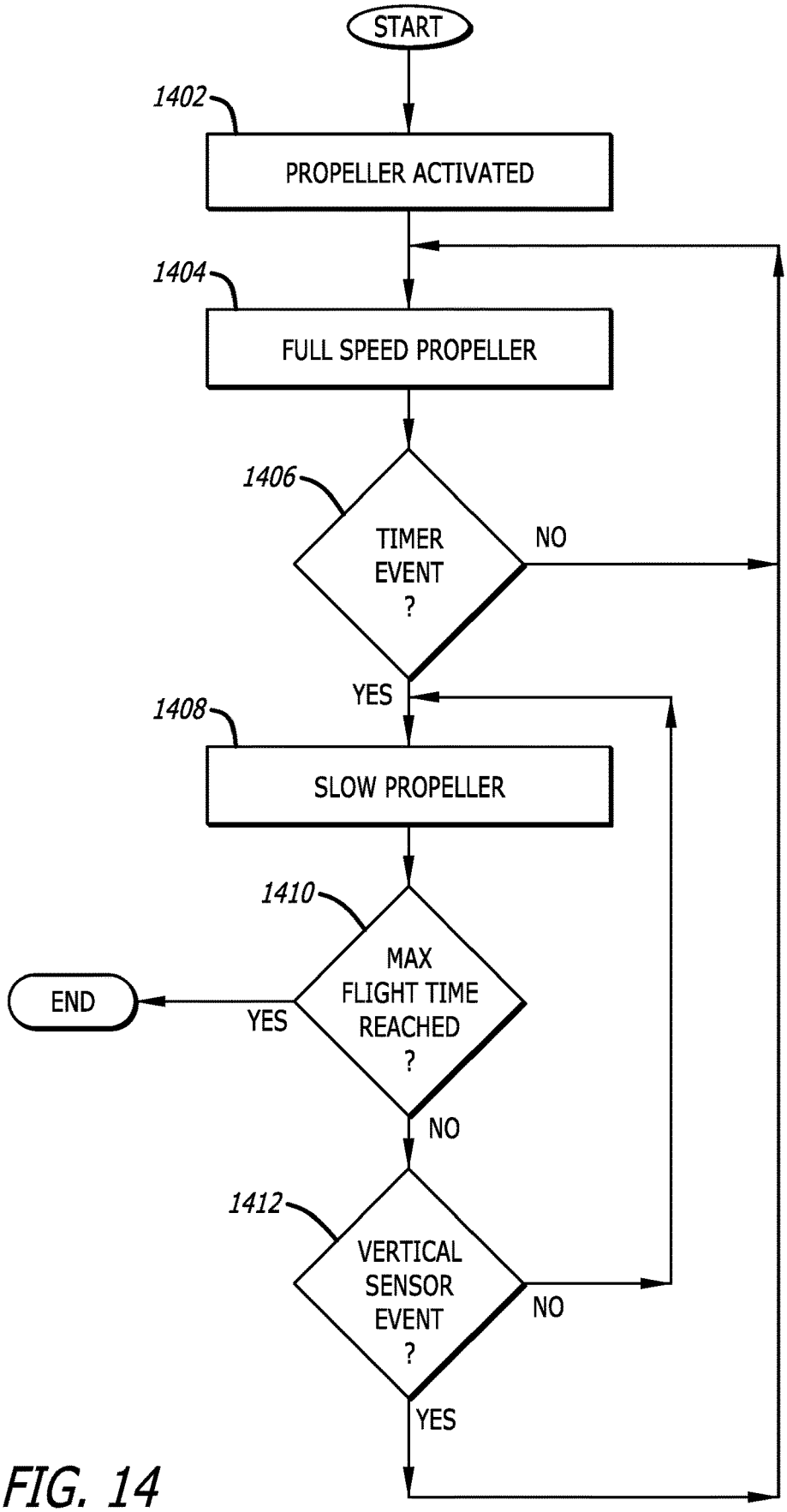
FIG. 14 is a flow diagram operation of the toy once activated according to one embodiment of the invention.

FIG. 14 is a flow diagram operation of the toy once activated according to one embodiment of the invention. At block 1402, the propeller of the toy is activated. The propeller is driven at full speed at block 1404. This causes the toy to rise at its maximum rate in the vertical direction. A determination is made at decision block 1406 whether a timer event has occurred. If no timer event has occurred the propeller continues to be driven at full speed. The net effect is that the propeller will be driven at full speed for a defined time period. In one embodiment, a timer event occurs after three seconds. In other embodiments, the timer event may occur after a longer or a shorter time. It is important that the window before the timer event is sufficiently long that the toy will fully escape the container.

Once the time event occurs at block 1406, the propeller is slowed at block 1408. A determination is made at block 1410 if a maximum flight time has been reached. If it ha the propeller is stopped completely and the session ends. If it has not a determination is made at block 1412 if a vertical sensor event has occurred. Slowing propeller sufficiently will result in the toy descending in the vertical direction which will eventually trigger a vertical sensor event. If while the propeller is slowed, a vertical sensor event has not occurred, the propeller is slowed further and the process repeats. If the vertical sensor event has occurred, the propeller is driven at full speed again at block 1404 and the process repeats.

Asynchronous events such as propeller contact with a stationary object will also cause the propeller to be shut down in some embodiments. It is also possible for depletion of the toy's power source to cause the toy to shut down.

While various aspect of embodiments of the invention are described with reference to flow diagrams, it should be understood that in some embodiments element of the flow diagrams may be performed in a different order or in parallel to rather than the order shown. Applicant expressly does not intend to imply a particular temporal relationship unless expressly stated in the claims that follow. Furthermore, to the extent that a decision element is included in the flow diagram, in some cases, that decision may be implicit or default. That is asynchronous selection of an execution path, e.g., interrupt driven, is within the scope and contemplation off embodiments of the invention.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a flying toy having a self-contained power source, a processor coupled to the power source by a circuit and a propeller having at least one blade, the propeller driven by an actuator, the toy defining an opening from an external surface to the circuit, the processor controlling the actuator that drives the propeller to provide lift to the toy;

a container for the toy, the container defining a seat for the toy that uniquely defines an orientation of the toy when in the container, the container having a lid and a mechanical interrupter to insert into the opening when the lid is closed, the mechanical interrupter configured to interrupt the circuit when the toy is in the seat and the lid is closed;

wherein opening the lid causes withdrawal of the mechanical interrupter to close the circuit, and wherein the toy automatically flies out of the container responsive to the mechanical interrupter being withdrawn.

2. The apparatus of claim 1 further comprising:

a linkage coupled between the lid and the mechanical interrupter, the linkage mechanically moving responsive to the opening of the lid and overcoming a bias force so as to withdraw the mechanical interrupter when the lid reaches a threshold degree of openness.

3. The apparatus of claim 1 further comprising:

a spring having a bias that biases the mechanical interrupter to withdraw from the opening; and a cam surface that overcomes the bias to force the mechanical interrupter into the opening as the lid closes.

4. The apparatus of claim 1 wherein the mechanical interrupter is biased into an inserted orientation:

at least one sensor to detect when the lid is in an open orientation; and an actuator to apply a force sufficient to overcome the bias on the mechanical interrupter responsive to the sensor detecting the lid is in the open orientation.

5. The apparatus of claim 1 wherein the container has a clam shell configuration comprising:

a base that defines the seat for the toy;

the lid;

and a hinge coupling the lid to the base and enabling greater than 120° of rotation of the lid relative to the base.

6. The apparatus of claim 5 wherein the mechanical interrupter continues to interrupt the circuit until the lid is opened greater than 90°.

7. The apparatus of claim 1 wherein the toy further comprises:

a vertical distance sensor and a processor to control the actuator to maintain a vertical distance between the toy and a detected surface within a defined distance range.

8. The apparatus of claim 1 wherein the container comprises:

an external shell formed of a translucent synthetic material.

9. The apparatus of claim 8 further comprising:

at least one light source coupled to the container and, when illuminated, visible through the translucent external shell.

10. The apparatus of claim 1 wherein the container further comprises an actuator to cause the container to at least one of vibrate or rock in a closed orientation responsive to a prompting action of a user.

11. The apparatus of claim 10 wherein the actuator alternatingly drives a first and a second foot through a bottom surface of the container.

12. The apparatus of claim 1 further comprising:

a processor disposed within the container;

a switch coupled to the processor to select a mode of operation for the processor.

* * * * *